United States Patent [19]

Johnson et al.

[11] 4,361,735

[45] Nov. 30, 1982

[54] ELECTRET MICROPHONE CIRCUIT

[75] Inventors: Edward G. T. Johnson, Woodbridge; Adrian J. Morgan, Framlingham, both of England

[73] Assignee: The Post Office, London, England

[21] Appl. No.: 147,342

[22] Filed: May 5, 1980

Related U.S. Application Data

[63] Continuation of Ser. No. 935,718, Aug. 21, 1978, abandoned.

[30] Foreign Application Priority Data

Aug. 24, 1977 [GB] United Kingdom ..... 35461/77

[51] Int. Cl.[3] ..... H04R 3/00; H04R 19/04

[52] U.S. Cl. ..... 179/111 E; 179/1 A; 307/400

[58] Field of Search ..... 179/1 A, 100.41 B, 111 R, 179/111 E, 106; 307/88 ET

[56] References Cited

U.S. PATENT DOCUMENTS

| | | | |
|---|---|---|---|
| 1,027,494 | 5/1912 | McMeen | 179/106 |
| 2,755,796 | 7/1956 | Boucke | 179/111 R |
| 3,373,251 | 3/1968 | Seeler | 179/111 R |
| 3,991,285 | 11/1976 | van den Worm et al. | 179/111 E |

FOREIGN PATENT DOCUMENTS

| | | | |
|---|---|---|---|
| 881584 | 11/1961 | United Kingdom | 179/111 R |
| 1305303 | 1/1973 | United Kingdom . | |

*Primary Examiner*—George G. Stellar

*Attorney, Agent, or Firm*—Mason, Fenwick & Lawrence

[57] ABSTRACT

An electroacoustic transducer for a microphone comprises an electret wherein an additional capacitance substantially greater than the capacitance normally inherent in the electret is connected in parallel with the electret. The additional capacitance may be of the order of 10 times greater than the capacitance normally inherent in the electret and may be produced inherently in the transducer or by a separate component connected to the transducer.

11 Claims, 7 Drawing Figures

PRIOR ART

ELECTRET MICROPHONE CIRCUIT

This is a continuation of application Ser. No. 935,718, filed Aug. 21, 1978, now abandoned.

This invention relates to an electroacoustic transducer for a microphone and in particular, but not exclusively to a transducer used as a telephone transmitter.

An amplifier connected to the output of an electret microphone must normally not only be able to handle large currents (of the order of 100 mA) but must also have a high input impedance. In the past it has usually been the practice to use a Field Effect Transistor as the input stage of the amplifier to provide the high input impedance and then to use bipolar transistors for the remaining stages of the amplifier. However, if such a Field Effect Transistor is added at the input stage of the amplifier and the bipolar and FET technology combined in one integrated circuit, the manufacture of the integrated circuit becomes difficult and expensive. This problem arises for example with a telephone if an electret microphone is used as a direct replacement for a carbon transmitter.

It is an object of the invention to provide an electroacoustic transducer for a microphone wherein the transducer has a reduced input impedance.

The present invention provides an electroacoustic transducer for a microphone, the transducer comprising an electret wherein an additional capacitance substantially greater than the capacitance normally inherent in the electret is connected in parallel with the electret.

The provision of this additional capacitance reduces the high input impedance required of an amplifier connected to the output of the transducer at the expense of a loss in sensitivity of the microphone. The size of the additional capacitance added must be sufficient to enable the input impedance requirement of the amplifier to be met; the limit to the capacitance which can be added is determined by the minimum signal to noise ratio that is allowable.

The additional capacitance may be 2 to 50 times greater than the capacitance normally inherent in the electret. If the additional capacitance is as much as 50 times greater the sensitivity of the microphone is reduced by a factor of about 50 while the input impedance of an amplifier connected to the electret may be correspondingly lower. Thus for amplifiers of high gain but low input impedance the additional capacitance must be relatively large. Conversely if the additional capacitance is only 2 times greater than the capacitance normally inherent in the electret, then the sensitivity of the microphone is reduced only by a factor of about 3 but there is correspondingly little change in the requirement of the input impedance of the amplifier.

In one embodiment of the invention the additional capacitance is of the order of 10 times greater than the capacitance normally inherent in the electret. In a particular example the electret is to be connected to an amplifier offering 100 KΩ input impedance and 38 dB gain; in this case an electret of capacitance 130 pf is used and additional capacitance of 1500 pf is connected in parallel with the electret. This reduces the sensitivity of the microphone by about 22 dB.

The additional capacitance may be produced inherently in the structure of the transducer: for example, conducting and dielectric elements may be so arranged within the transducer that they provide the requisite capacitance. The conducting and dielectric elements may each be of a substantially cylindrical shape.

Alternatively a length of high capacity connecting cable may be connected to the output of the electret to provide the additional capacitance or a discrete component having the additional capacitance may be connected in parallel with the output of the electret. In one embodiment of the invention a plug of dielectric material is mounted in an electrically conducting casing housing the electret with a conductor passing through the plug and forming in combination with the plug and the casing the additional capacitance.

The additional capacitance may be provided by a combination of the arrangements described above.

The present invention further provides a telephone incorporating an electroacoustic transducer as defined above.

Certain illustrative embodiments of the invention will now be described with reference to the accompanying drawings, of which:

Figure 1:
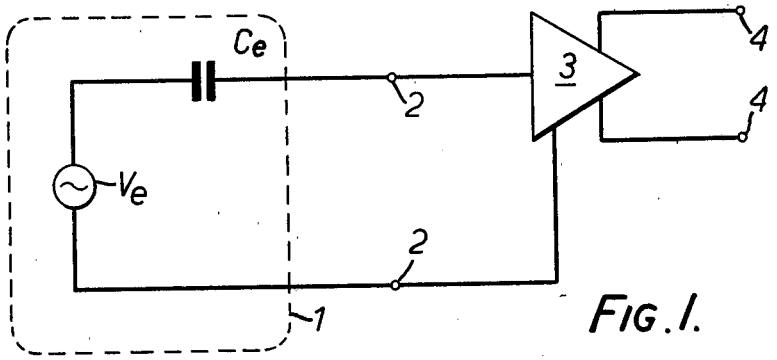
FIG. 1 is a circuit diagram of an electret and amplifier combination without any additional capacitance connected in parallel with the electret.

FIG. 1 shows a transducer comprising an electret 1, having an output across terminals 2, connected to the input of an amplifier 3 which provides an output across terminals 4. The electret 1 is shown in the form of its idealised Norton equivalent circuit, as comprising a voltage generator generating a voltage Ve connected in series with a capacitor Ce, which represents the capacitance normally inherent in an electret.

Figure 2:
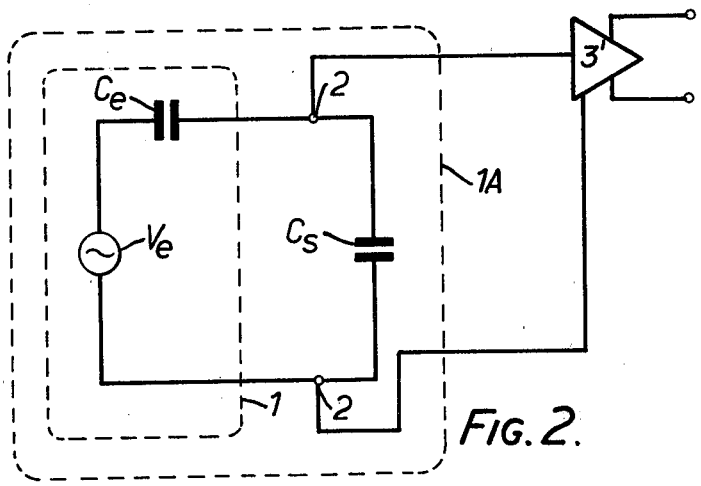
FIG. 2 is a circuit diagram of an electret and amplifier combination with an additional capacitance connected in parallel with the electret.
Figure 3:
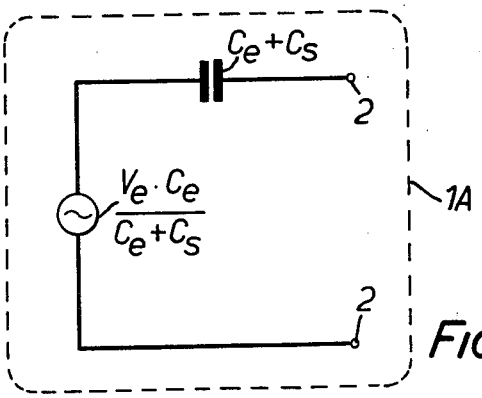
FIG. 3 is another form of the circuit diagram of FIG. 2.

FIG. 2 shows a transducer 1A comprising the electret 1 with a capacitor of capacitance Cs connected across the terminals 2 of the electret. This capacitance Cs can be combined with the capacitance Ce to yield the Norton equivalent circuit shown in FIG. 3. As shown in FIG. 3 the transfer of the capacitance Cs reduces the voltage of the voltage generator to a value Ve.Ce/(Ce+Cs) and increases the capacitance in series with the generator to Ce+Cs. Thus the sensitivity of the transducer is reduced by a factor of (Ce+Cs)/Ce while the impedance of the equivalent source capacitance is increased by the same factor.

In a particular example of the invention the amplifier 3' comprises a bipolar integrated circuit with an input impedance of 100 KΩ and 38 dB gain. In order to obtain a −3 dB low frequency breakpoint at 1 kHz which would be suitable for use in telephones, the impedance presented by the capacitance Ce+Cs must therefore be 100 KΩ at 1 kHz which represents a total capacitance of approximately 1,600 pf. In this example the electret 1 has a capacitance Ce of 130 pf so that the shunting capacitance Cs must be approximately 1,470 pf, or to the nearest preferred value 1,500 pf.

With Ce=130 pf and Cs=1,500 pf as above the sensitivity of the microphone is reduced by a factor of $(130+1500/130)\approx 12.5$. This is a drop in sensitivity of approximately 22 dB.

Typically the overall sensitivity of the complete microphone (the electret 1 and the amplifier 3') required for a telephone application is −14 dBV/Pa. Since the amplifier 3' has a gain of 38 dB the sensitivity of the transducer 1A (the electret 1 together with the additional capacitance Cs) must be −52 dBV/Pa, and since the provision of the shunt capacitance Cs reduces the sensitivity of the transducer 1A by 22 dB, the open circuit sensitivity of the electret 1 must be −30 dBV/Pa. Such a sensitivity can easily be achieved by an electret.

Figure 4:
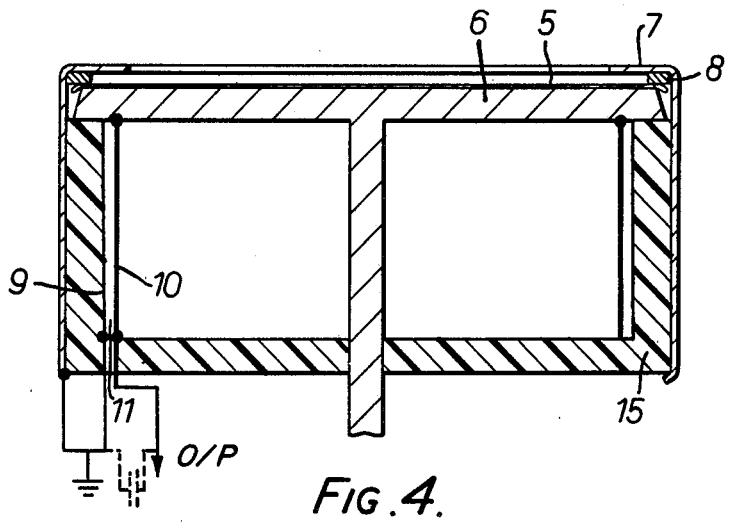
FIG. 4 is a sectional view of a transducer incorporating an electret and embodying the invention.

FIG. 4 shows a construction of transducer in which the additional capacitance is provided as an integral part of the transducer. The transducer comprises an electret foil diaphragm 5 mounted between an electrically conducting backplate 6 and an electrically conducting case 7 which makes contact with the front face of the foil diaphragm through an annular metallic ring 8. The diaphragm 5 prevents the backplate 6 contacting the case 7. The case 7 is fitted over a body member 15. A cylindrical conductor 9 is electrically connected to the case 7 and electrically insulated from the backplate 6 and a cylindrical conductor 10 arranged coaxially within the conductor 9 is electrically connected to the backplate and electrically insulated from the case 7. A cylindrical layer of dielectric 11 separates the conductors 9 and 10 and defines in combination with the conductors a cylindrical capacitor connected in parallel across the output of the electret thus providing an integral shunt capacitance.

The details of the construction of the transducer are not of importance to this embodiment of the invention and will not be described. It will be understood that the output of the transducer is taken from a lead electrically connected to the conductor 10, the case 7 being earthed.

Figure 6:
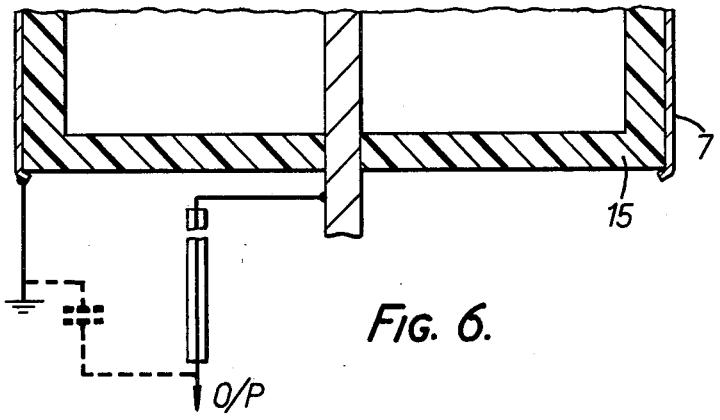
FIG. 6 is a sectional view of part of another modified form of the transducer of FIG. 4.
Figure 7:
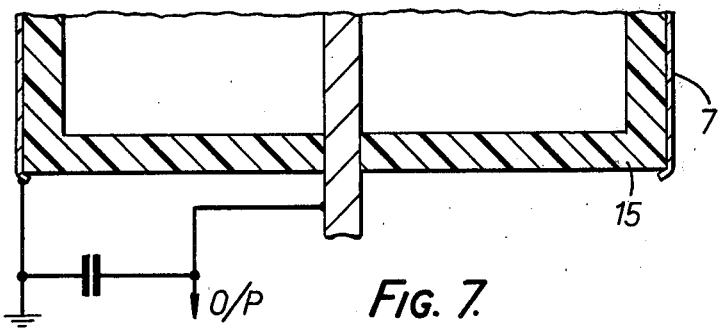
FIG. 7 is a sectional view of part of another modified form of the transducer of FIG. 4.

As an alternative to providing the capacitance integrally as described with reference to FIG. 4, a high capacity cable of suitable length may be connected to the output of the electret (FIG. 6) or a conventional capacitor may be connected across the output of the electret (FIG. 7).

Figure 5:
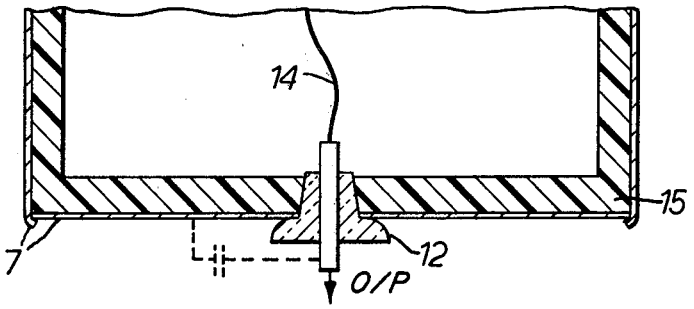
FIG. 5 is a sectional view of part of a modified form of the transducer of FIG. 4.

FIG. 5 shows a construction of the rear of a transducer which may alternatively be used to provide the capacitance. The case 7 and body member 15 of the transducer has a central hole in which a feed-through type coaxial ceramic capacitor is fitted. A conductor 14 is electrically connected to the backplate (not shown in FIG. 5) and the required capacitance provided between the conductor 14 and the case 7.

Alternatively any of these methods may be used in combination to provide the required capacitance in parallel with the electret; for example, the integral capacitor described with reference to FIG. 4 may be used to provide part of the required capacitance and a high capacity lead may be used to provide the remaining part of the required capacitance.

Transducers constructed in the manner described above enable electrets to be used with the same amplifiers as other transducers such as piezo-electric transducers.

Although the embodiments of the invention have been described with reference to telephone applications it should be understood that transducers embodying the invention may be of service in any application where the loss in sensitivity due to the connection of the additional capacitance can be accommodated.

What is claimed is:

1. An electroacoustic transducer for a microphone, the transducer comprising an electret and means for reducing the impedance of the transducer so that the input impedance requirements of an amplifier connected to the transducer are correspondingly reduced, the impedance reducing means consisting of an additional capacitance substantially greater than the capacitance normally inherent in the electret in parallel with the electret, there being substantially no resistance provided in the transducer in series with the electret.

2. A transducer as claimed in claim 1 in which the additional capacitance is 2 to 50 times greater than the capacitance normally inherent in the electret.

3. A transducer as claimed in claim 2 in which the additional capacitance is of the order of 10 times greater than the capacitance normally inherent in the electret.

4. A transducer as claimed in claim 1 in which the additional capacitance is produced inherently in the transducer.

5. A transducer as claimed in claim 4 in which conducting and dielectric elements are so arranged within the transducer that they provide the requisite capacitance.

6. A transducer as claimed in claim 5 in which the conducting and dielectric elements are each of a substantially cylindrical shape.

7. A transducer as claimed in claim 1 in which a length of high capacity connecting cable is connected to the output of the electret to provide the additional capacitance.

8. A transducer as claimed in claim 1 in which a discrete component having the additional capacitance is connected in parallel with the output of the electret.

9. A transducer as claimed in claim 1 in which a plug of dielectric material is mounted in an electrically conducting casing housing the electret with a conductor passing through the plug and forming in combination with the plug and the casing the additional capacitance.

10. A transducer as claimed in claim 1 in which the additional capacitance is provided by any combination of the following:

- a capacitance produced inherently in the transducer;
- conducting and dielectric elements arranged within the transducer to provide a capacitance;
- a length of high capacity connecting cable;
- a discrete component; and
- a plug of dielectric material mounted in an electrically conducting casing housing the electret with a conductor passing through the plug and forming in combination with the plug and the casing a capacitance.

11. A telephone incorporating a microphone comprising an electret wherein an additional capacitance substantially greater than the capacitance normally inherent in the electret is connected in parallel with the electret.

* * * * *